US005184583A

United States Patent [19]

Grell

[11] Patent Number: 5,184,583

[45] Date of Patent: Feb. 9, 1993

[54] LIGHT METAL TAPPET WITH WEAR-RESISTANT ARMOURING MADE OF A STEEL WITH AN AUSTENITIC MATRIX

[75] Inventor: Karl-Ludwig Grell, Aurachtal, Fed. Rep. of Germany

[73] Assignee: INA Walzlager Schaeffler KG, Fed. Rep. of Germany

[21] Appl. No.: 824,017

[22] Filed: Jan. 22, 1992

[30] Foreign Application Priority Data

Feb. 1, 1991 [DE] Fed. Rep. of Germany ..... 4102988

[51] Int. Cl.[5] ..... B23P 11/02; F01L 1/24; F01L 1/14; F01L 1/16

[52] U.S. Cl. ..... 123/90.51; 29/888.43

[58] Field of Search ..... 123/90.51; 29/888.03, 29/888.43

[56] References Cited

U.S. PATENT DOCUMENTS

| | | | |
|---|---|---|---|
| 4,850,095 | 7/1989 | Akao et al. | 29/888.03 |
| 4,873,150 | 10/1989 | Doi et al. | 123/90.51 |
| 4,909,198 | 3/1990 | Shiraya et al. | 123/90.51 |
| 4,924,825 | 5/1990 | Speil | 123/90.51 |
| 5,129,372 | 7/1992 | Sieberth et al. | 123/90.51 |

*Primary Examiner*—Willis R. Wolfe
*Assistant Examiner*—M. Macy
*Attorney, Agent, or Firm*—Bierman and Muserlian

[57] ABSTRACT

A light metal tappet particularly for the timing gear of an internal combustion engine comprising a tappet base body and a steel plate anchored at the contact face for the control cams of the timing gear and having a hardened surface, characterized in that the steel plate is made of an austenitic base material which is carbon dispersion hardened, has the same coefficient of thermal expansion as aluminium and comprises a nitrided surface.

20 Claims, 2 Drawing Sheets

LIGHT METAL TAPPET WITH WEAR-RESISTANT ARMOURING MADE OF A STEEL WITH AN AUSTENITIC MATRIX

STATE OF THE ART

A light metal tappet particularly for the timing gear of an internal combustion engine comprising a tappet base body and a steel plate which is anchored at the contact face for the control cams of the timing gear and has a hardened surface is known for example from EP 0 030 780 B1. They are subjected in operation to relatively large temperature fluctuations reaching from −30° C. on cold starting to about 130° C. during the operation of an internal combustion engine. The problematic aspect of this is the possibly differing thermal expansion of the materials employed. It is true that the steel plate anchored as a wear-resistant insert in a light metal tappet possesses good wear properties, but if thermal loading is severe enough, the steel plate tends to become detached. The thermal loadability is therefore limited. A further disadvantage from the point of view of practical use is that design space is lost due to the relatively wide edge which serves as a functioning surface or cam contact face against which the control cam of a timing gear runs.

OBJECTS OF THE INVENTION

It is an object of the invention to provide a light metal tappet with an anchored steel plate whose surface has a high ductility and at the same time high wear resistance and hardness.

It is another object of the invention to provide a method of producing the light metal tappet of the invention.

These and other objects and advantages of the invention will become obvious from the following detailed description.

THE INVENTION

The novel light metal tappet of the invention particularly for the timing gear of an internal combustion engine, comprising a tappet base body (11) and a steel plate anchored at the contact face for the control cams of the timing gear and having a hardened surface, is characterized in that the steel plate (12) is made of an austenitic base material which is carbon dispersion hardened, has the same coefficient of expansion as aluminium and comprises a nitrided surface (16).

The steel plate is made of an austenitic base material which is carbon dispersion hardened, has the same coefficient of expansion as aluminium and comprises a nitrided surface, an additional hardening being obtained by the fact that the surface of the steel plate is additionally work-hardened. The work-hardening of the surface of the steel plate is effected by shot-peening. By this measure, a wear plate is obtained which is very hard and very tough and which retains its hardness even at flash temperatures which can occur on eventual friction under deficient lubrication, that is to say, the wear plate is particularly resistant to thermomechanical loading.

In one embodiment of the invention, the steel plate is welded to a tappet base body which has a thin-walled cup jacket made of an aluminium alloy, particularly of AlSi 18 CuMgNi, with a wall thickness of approximately 0.6 to 2.5 mm. According to another embodiment of the invention, the coefficients of thermal expansion of the tappet base body and the steel plate are almost identical and the tappet base body is made of a ceramic, a plastic or a duroplastic material or of a fiber reinforced light metal.

To achieve a stable joint between the tappet base body and the steel plate, in a further advantageous embodiment of the invention, the steel plate has on its under-surface facing the tappet body, retaining means provided with retaining teeth.

The invention further concerns a method of manufacturing a light metal tappet particularly for the timing gear of an internal combustion engine comprising a tappet base body and a steel plate which is anchored at the contact face for the cams of the timing gear and has a hardened surface, enabling the manufacture of a light metal tappet comprising an anchored steel plate wherein a steel plate having an austenitic matrix is carburized and dispersion hardened with subsequent nitriding of the surface facing the control cam. It is advantageous to nitride the surface during the heat treatment or to additionally work-harden the surface with nitriding being effected either in a gas stream, a nitriding salt bath or by a plasma process.

As the base material for a surface-hardened steel plate anchored in a light metal tappet, a high alloy austenitic steel free of martensite is used which can be additionally carbon dispersion hardened, nitrided in a bath or work-hardened.

Referring now to the drawings

Figure 1:
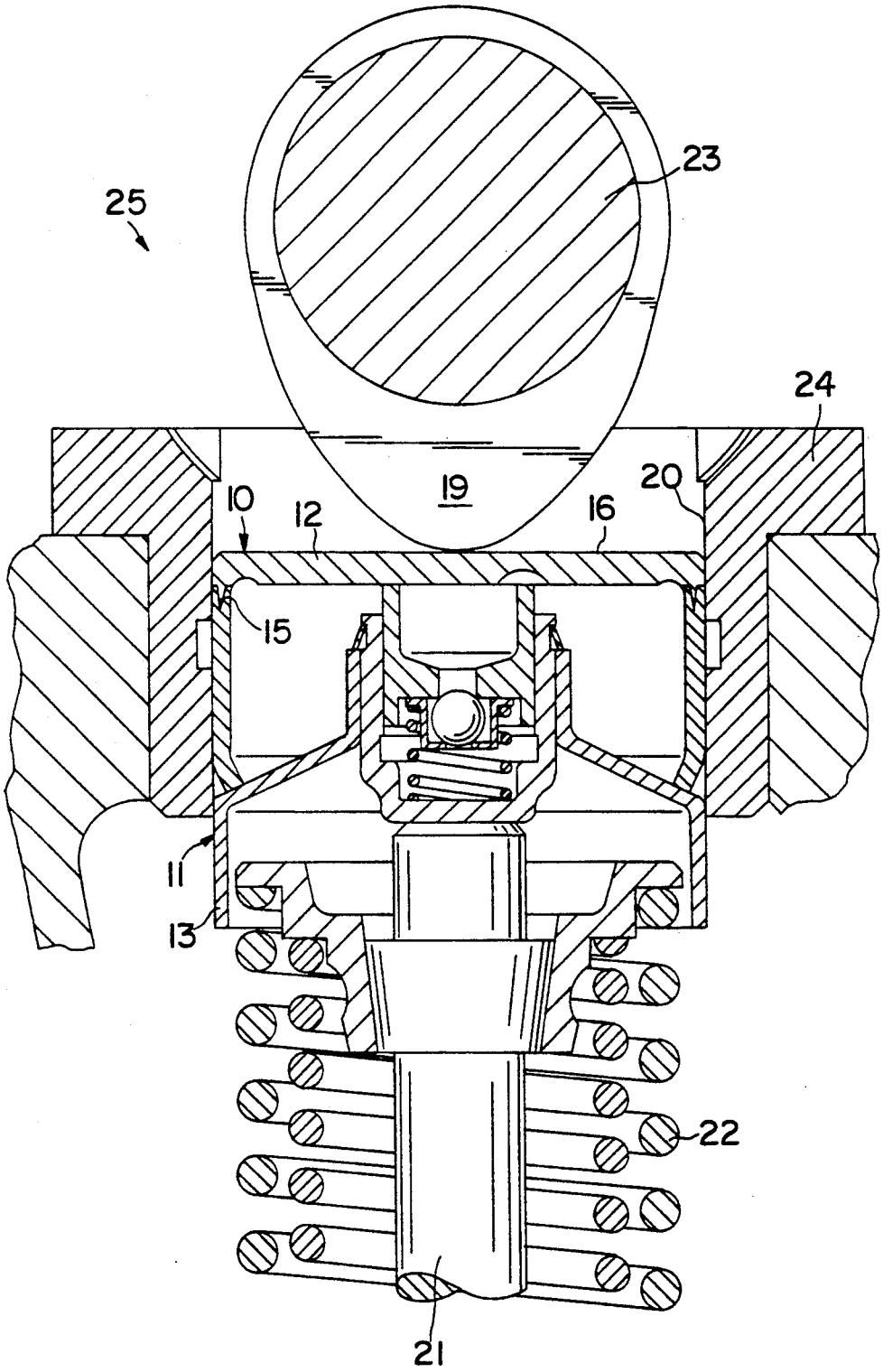
FIG. 1 is a longitudinal section of a valve tappet of the invention, mounted between a control cam and a valve stem.

As can be seen in FIG. 1, the timing gear 25 of an internal combustion engine, not shown, comprises essentially a control cam 19 which acts against the surface 16 of a tappet 10, the control cam 19 being mounted in a non-rotatable manner on a camshaft 23. The tappet 10 is mounted for upward and downward motion in a slideway 20 of a cylinder head 24, not shown, and at its end turned away from the control cam 19, it acts against the valve stem 21 of a valve, not shown. A valve spring 22 for the re-positioning of the tappet 10 is associated with the valve stem 21.

Figure 2:
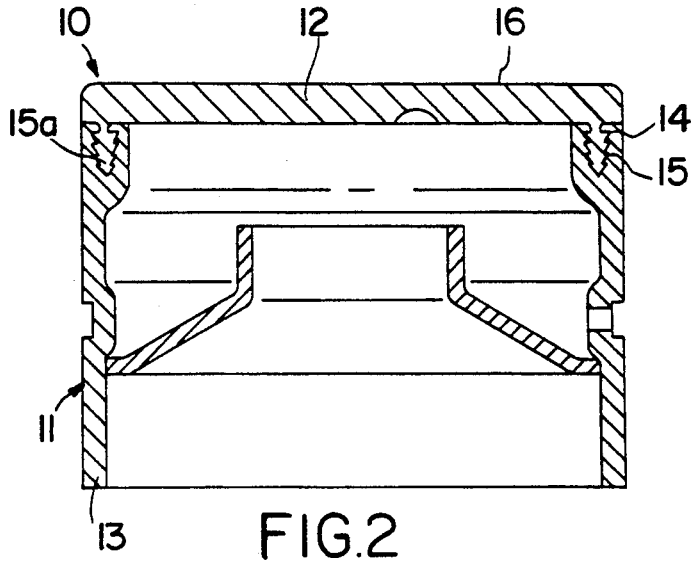
FIG. 2 is a section through a light metal tappet with a thin-walled cup jacket onto which a wear-resistant steel plate has been welded.

The tappet 10 shown in detail in FIG. 2 is made of a light metal alloy, for example AlSi 18 CuMgNi, and comprises a tappet body 11 in which a steel plate 12 is anchored or welded. The tappet or cup body 11 comprises a tappet housing or cup jacket 13 which is turned away from the steel plate 12, and which at its end facing the steel plate 12, comprises an annular groove 14. The steel plate 12 comprises retaining means 15*a* provided with retaining teeth 15 with which it can be pressed into the annular groove 14 or be fixed there by casting-in or compression.

The steel plate 12 comprises an austenitic matrix which is hardened by carbon dispersion hardening. The surface 16 of the steel plate 12 turned away from the tappet body 11 is nitrided, i.e., it is enriched with nitrogen. The surface 16 is thus endowed with a wear layer which is firmly connected with the matrix by diffusion.

To further increase the wear resistance, the surface 16 can be work-hardened.

Figure 3:
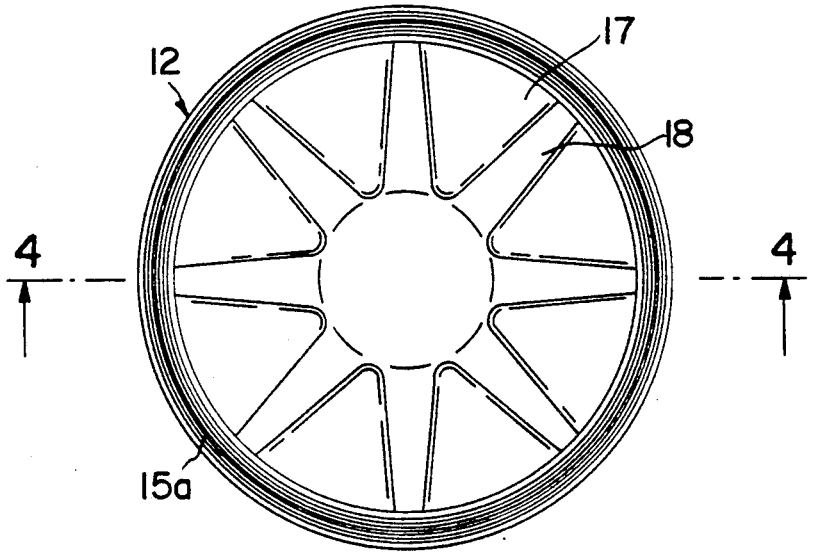
FIG. 3 is a detailed representation of a steel plate comprising reinforcing ribs which is to be joined to a light metal tappet.
Figure 4:
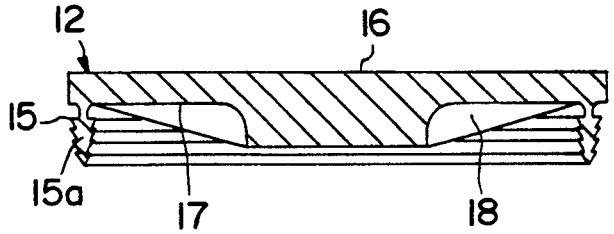
FIG. 4 is a cross-section through the steel plate of FIG. 3 along the line of A—A.

In the embodiment shown in FIGS. 3 and 4, the inner surface 17 of the steel plate 12 comprises outwards oriented spoke-shaped stiffening elements 18. A steel plate 12 of this type is made of a high alloy steel, for example X5CrNil8 9. The coefficient of thermal expansion of this steel is almost identical to that of the aforementioned light metal alloy of which the tappet 10 is made. By reason of the austenitic matrix, the steel plate 12 has a high ductility and due to the nitriding and work-hardening of the surface 16, it is particularly wear-resistant at the contact face for the control cam 19 and suited for mounting in a cylinder head 24, not represented, of an internal combustion engine with timing gear 25.

Various modifications of the tappet and method of the invention may be made without departing from the spirit or scope of thereof and it is to be understood that the invention is intended to be limited only as defined in the appended claims.

What I claim is:

1. A light metal tappet particularly for the timing gear of an internal combustion engine, comprising a tappet base body (11) and a steel plate anchored at the contact face for the control cams of the timing gear and having a hardened surface, characterized in that the steel plate (12) is made of an austenitic base material which is carbon dispersion hardened, has the same coefficient of thermal expansion as aluminium and comprises a nitrided surface (16).

2. A light metal tappet of claim 1 wherein the nitrided surface (16) of the steel plate (12) is additionally work-hardened.

3. A light metal tappet of claim 2 wherein the nitrided surface (16) of the steel plate (12) is work-hardened by shot-peening.

4. A light metal tappet of claim 1 wherein the steel plate (12) is welded onto a tappet base body (11) having a thin-walled cup jacket (13).

5. A light metal tappet of claim 4 wherein the cup jacket (13) is made of an aluminium alloy with a wall thickness of approximately 0.6 to 2.5 mm.

6. A light metal tappet of claim 5 wherein the aluminium alloy is AlSi 18 CuMgNi.

7. A light metal tappet of claim 1 wherein the steel plate (12) is made of a high alloy austenitic steel free of martensite.

8. A light metal tappet of claim 7 wherein the steel plate (12) is made of X5CrNi 18 9.

9. A light metal tappet of claim 1 wherein the coefficients of thermal expansion of the tappet base body (11) and the steel plate (12) are almost identical.

10. A light metal tappet of claim 1 wherein the tappet base body (11) is made of a ceramic, a plastic, or a duroplastic material or of a fiber reinforced light metal alloy.

11. A light metal tappet of claim 1 wherein the steel plate (12) comprises retaining means (15*a*) provided with retaining teeth (15) on its under-surface facing the tappet base body (11).

12. A light metal tappet with an anchored, surface-hardened steel plate of claim 1 wherein the base material is a carbon dispersion hardened steel.

13. A light metal tappet with an anchored surface-hardened steel plate of claim 1 wherein the base material is a steel which is nitrided in a bath.

14. A light metal tappet with an anchored, surface-hardened steel plate of claim 1 wherein the base material is a work-hardened steel.

15. A method of manufacturing a light metal tappet particularly for the timing gear of an internal combustion engine, comprising a tappet base body and a steel plate which is anchored at the contact face for the cams of the timing gear and has a hardened surface, characterized in that a steel plate having an austenitic matrix is carburized and dispersion hardened with subsequent nitriding of the surface facing the control cam.

16. The method of claim 15 wherein the surface is nitrided during the heat treatment.

17. The method of claim 15 wherein the surface is additionally work-hardened.

18. The method of claim 15 wherein nitriding is effected in a gas stream.

19. The method of claim 15 wherein nitriding is effected in a nitriding salt bath.

20. The method of claim 15 wherein nitriding is effected by a plasma process.

* * * * *